US011223155B1

(12) United States Patent
Marquez

(10) Patent No.: US 11,223,155 B1
(45) Date of Patent: Jan. 11, 2022

(54) ELECTRICAL CONNECTOR CAVITY PLUG AND COVER ASSEMBLY

(71) Applicant: Deere & Company, Moline, IL (US)

(72) Inventor: Jorge Marquez, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/075,107

(22) Filed: Oct. 20, 2020

(51) Int. Cl.

| | |
|---|---|
| ***H01R 13/443*** | (2006.01) |
| ***H01R 13/52*** | (2006.01) |
| ***H01R 13/627*** | (2006.01) |
| ***H01R 13/502*** | (2006.01) |
| ***H01R 13/629*** | (2006.01) |

(52) U.S. Cl.
CPC ..... *H01R 13/443* (2013.01); *H01R 13/502* (2013.01); *H01R 13/5205* (2013.01); *H01R 13/629* (2013.01); *H01R 13/6271* (2013.01)

(58) Field of Classification Search
CPC ..... H01R 13/443; H01R 13/502; H01R 13/5205; H01R 13/6271; H01R 13/629
See application file for complete search history.

(56) References Cited

U.S. PATENT DOCUMENTS 3,671,921 A * 6/1972 Charles, III ..... H01R 13/502 439/353
5,281,147 A * 1/1994 Hughes ..... B60D 1/64 439/35
5,325,455 A * 6/1994 Henson ..... G02B 6/3817 385/137
6,840,812 B2 * 1/2005 Devine ..... H01R 13/518 439/505
7,481,675 B2 1/2009 Patterson et al.
8,251,748 B2 8/2012 Tyler et al.
9,653,859 B1 * 5/2017 Moore ..... H01R 31/02
2011/0092833 A1 * 4/2011 Farrior ..... A61B 5/303 600/508
2011/0240359 A1 * 10/2011 Winters, Jr ..... G06F 1/182 174/350

OTHER PUBLICATIONS

TE Connectivity Ltd.,Industrial & Commercial Transportation, Terminals and Connectors brochure, www.te.com, Aug. 2015. (256 pages).

* cited by examiner

*Primary Examiner* — Abdullah A Riyami
*Assistant Examiner* — Nader J Alhawamdeh
(74) *Attorney, Agent, or Firm* — Klintworth & Rozenblat IP LLP

(57) ABSTRACT

A cavity plug for a plug assembly of an electrical connector having a housing defining contact receiving passageways includes a plug body, a cover support and a pin array. The cover support extends from the plug body in a first direction and is configured to support a connector cover that receives the housing. The pin array extends from the plug body in a second direction opposite the first direction and includes one or more blocking pins and one or more latching pins. Each blocking pin has a cylindrical body extending in the second direction and is sized for insertion into an associated contact receiving passageway of the plug assembly. Each latching pin extends in the second direction and is configured to cooperate with the plug assembly to inhibit separation of the cavity plug from the plug assembly.

20 Claims, 5 Drawing Sheets

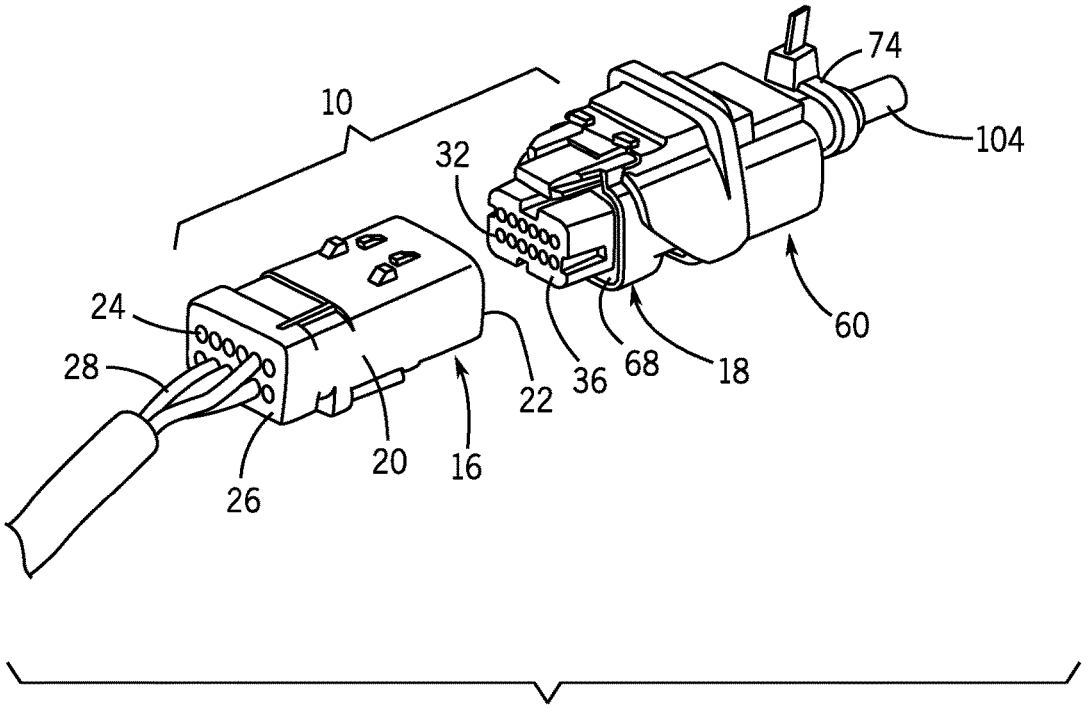
FIG. 5
FIG. 6
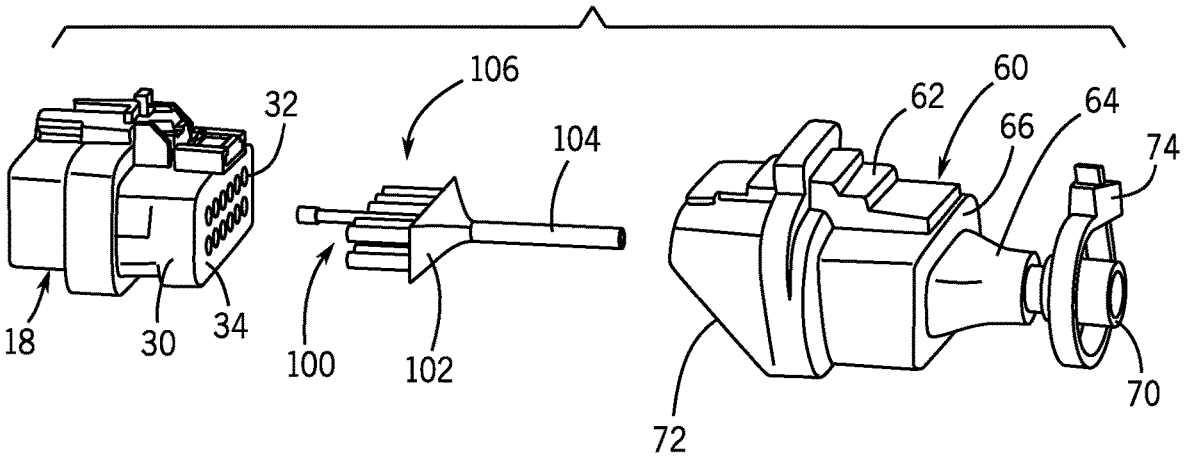

ELECTRICAL CONNECTOR CAVITY PLUG AND COVER ASSEMBLY

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to electrical connectors and, more particularly, to cavity plugs for such connectors that may be used to protect and cover the connectors during spray treatment of associated components.

BACKGROUND OF THE DISCLOSURE

Electrical connectors, such as high-voltage connectors used in various automotive and work vehicle industries, may serve to transfer electric current between or among sources of current and/or between sources of the current (e.g., one or more batteries or cells) and electric load components within a vehicle (e.g., various vehicle engine compartment components such as starters, alternators, generators and motors). Commonly, such electrical connectors have conductors and contacts that mate with contacts in other connectors to allow for coupling and decoupling of the electrical load components to and from the electrical power source(s).

Various and numerous steps are taken in the assembly and manufacture of vehicles and vehicle subsystems, including various cleaning, painting, rust-proofing and other spray applications. In the event that the electrical connectors are decoupled when such steps are taken, the connectors may need to be covered and protected against the associated pressures and/or material build-up at electrical contacts or openings of the connectors to avoid damage to sensitive elements and disruption to subsequent coupling and electrical connection of the connectors.

SUMMARY OF THE DISCLOSURE

The disclosure provides an improved cavity plug and cover assembly for electrical connectors, such as those used in vehicle wiring harnesses.

In one aspect, the disclosure provides a cavity plug for plug assembly of an electrical connector having a housing defining contact receiving passageways. The cavity plug includes a plug body, a cover support and a pin array. The cover support extends from the plug body in a first direction and is configured to support a connector cover that receives the connector housing. The pin array extends from the plug body in a second direction opposite the first direction and includes one or more blocking pins and one or more latching pins. Each blocking pin has a body extending in the second direction and is sized for insertion into an associated contact receiving passageway of the plug assembly. Each latching pin extends in the second direction and is configured to cooperate with the plug assembly to inhibit separation of the cavity plug from the plug assembly.

In another aspect, the disclosure provides a cavity plug for plug assembly of an electrical connector having a housing defining contact receiving passageways. The cavity plug includes a plug body, a cover support and a pin array. The cover support extends from the plug body in a first direction and is configured to support a connector cover that receives the connector housing. The pin array extends from the plug body in a second direction opposite the first direction and includes a plurality of blocking pins and at least one latching pin. Each blocking pin has a body extending in the second direction and is sized for insertion into an associated contact receiving passageway of the electrical connector. Each latching pin extends in the second direction and is configured to cooperate with the plug assembly to inhibit separation of the cavity plug from the plug assembly.

In another aspect, the disclosure provides a cavity plug and cover assembly for a plug assembly of an electrical connector having a housing defining contact receiving passageways. The assembly includes a connector cover defining an open end and an interior cavity sized to receive, at least in part, the housing of the plug assembly. The connector cover also including a mounting coupling. The cavity plug includes a plug body, a cover support and a pin array. The cover support extends from the plug body in a first direction and is configured to engage the mounting coupling of the connector cover. The pin array extends from the plug body in a second direction opposite the first direction and includes a plurality of blocking pins and at least one latching pin. Each blocking pin has a body extending in the second direction and is sized for insertion into an associated contact receiving passageway of the electrical connector. Each latching pin extends in the second direction and is configured to cooperate with the plug assembly to inhibit separation of the cavity plug from the plug assembly.

The details of one or more embodiments are set forth in the accompanying drawings and the description below. Other features and advantages will become apparent from the description, the drawings, and the claims.

BRIEF DESCRIPTION OF THE DRAWINGS

FIG. 5 is an exploded assembly view of the example electrical connector assembly with a cavity plug in accordance with the present disclosure and cover assembly mounted therein;

FIG. 6 is an exploded perspective view of a portion of the example connector and the cavity plug of FIG. 5 and the cover assembly;

Like reference symbols in the various drawings indicate like elements.

DETAILED DESCRIPTION

Figure 1:
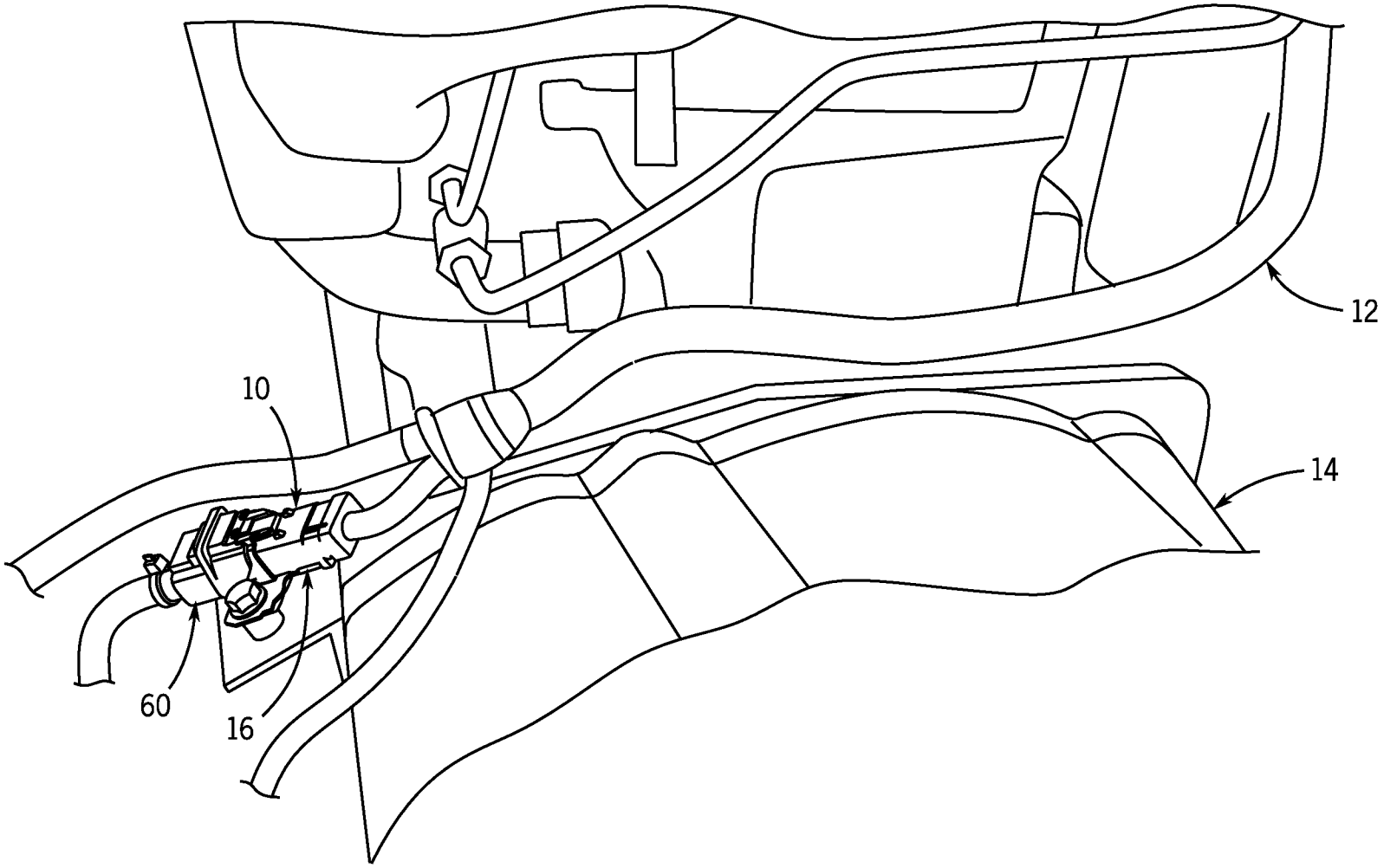
FIG. 1 is a partial perspective view of an example vehicle electrical connector assembly in which a cavity plug and cover assembly.
Figure 2:
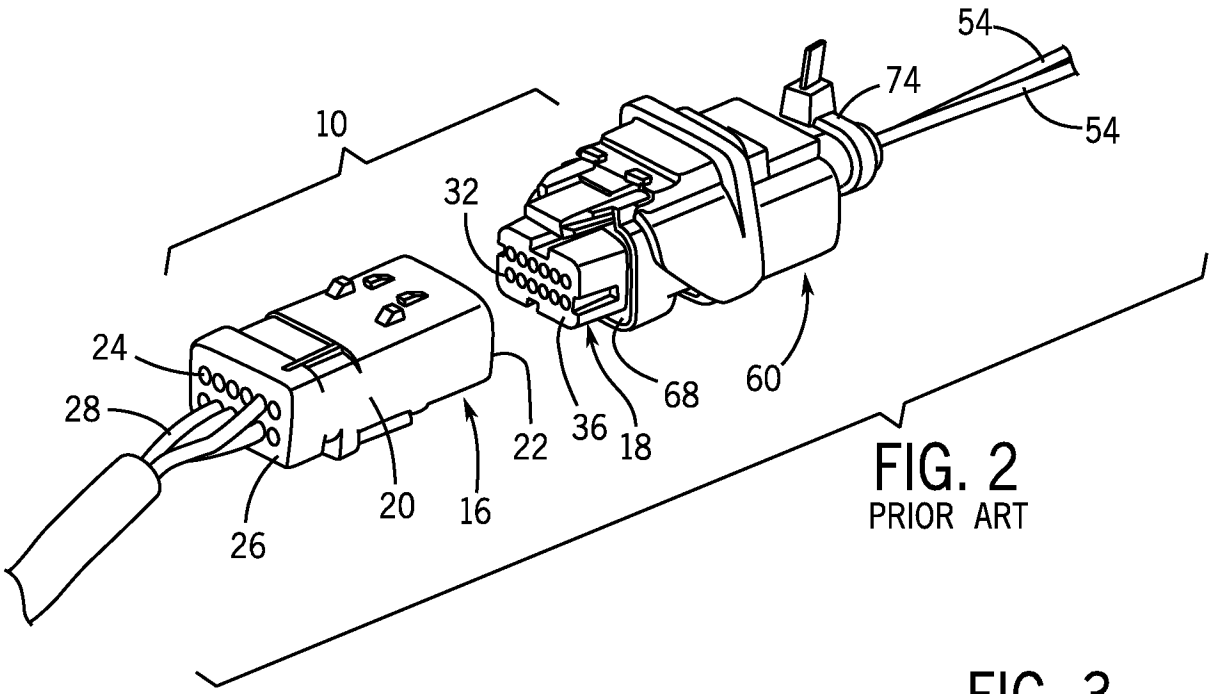
FIG. 2 PRIOR ART
FIG. 2 is an exploded assembly view of an example prior art electrical connector assembly with a prior art cavity plug and cover assembly mounted therein.
Figure 3:
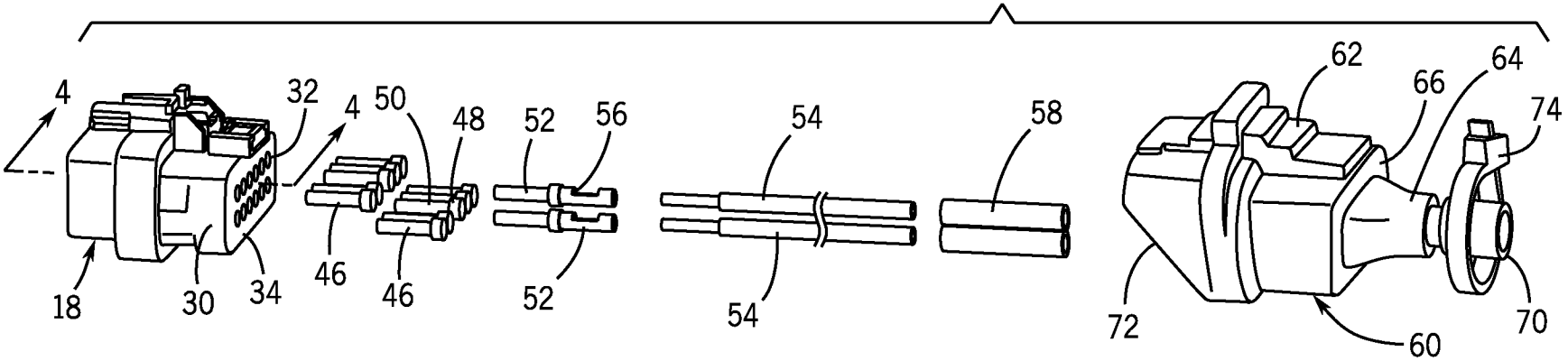
FIG. 3 PRIOR ART
FIG. 3 is an exploded perspective view of a portion of the example connector and the cavity plug and cover assembly of FIG. 2.
Figure 4:
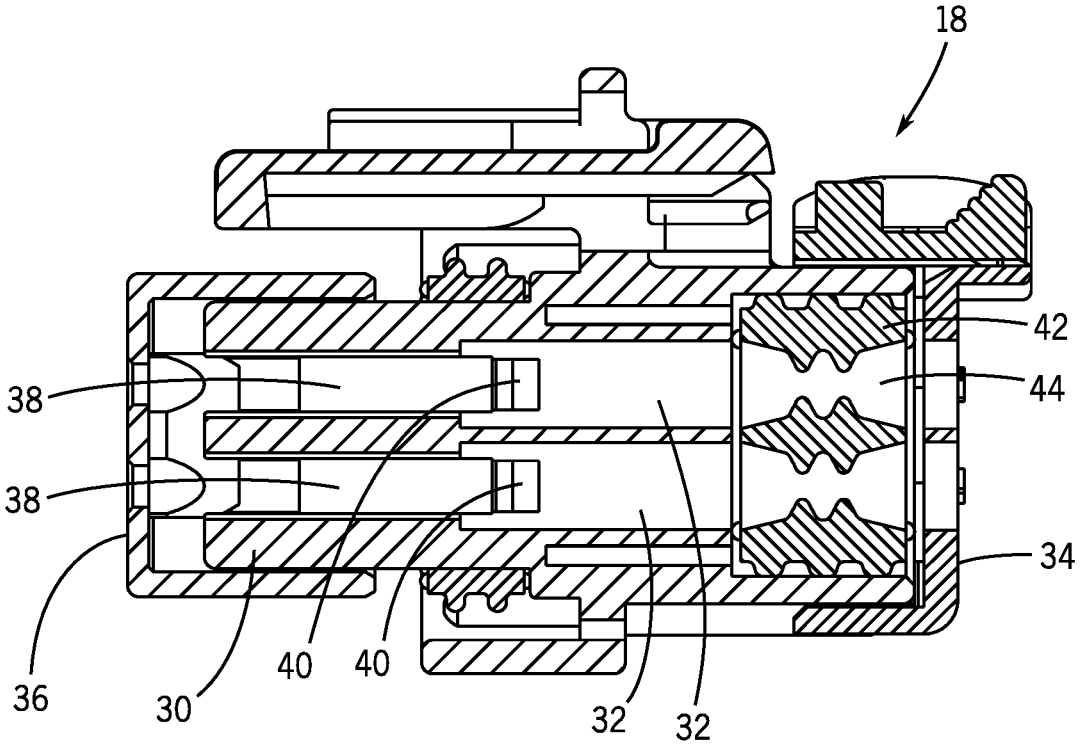
FIG. 4 PRIOR ART
FIG. 4 is a cross-sectional view along line 4-4 of FIG. 3.

The following describes one or more example embodiments of the disclosed cavity plug and cover assembly, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Furthermore, in detailing the disclosure, terms of direction and orientation, such as "longitudinal," "inner," "outer," "radial," "axial," "circumferential," "lateral," and "transverse" may be used. Such terms are defined, at least in part, with respect to a wheel axle, pivot axis, and/or a work vehicle. As used herein, the term "longitudinal" indicates an orientation along the length of the apparatus; the term "lateral" indicates an orientation along a width of the apparatus and orthogonal to the longitudinal orientation; and the term "transverse" indicates an orientation along the height of the apparatus and orthogonal to the longitudinal and lateral orientations. These orientations may be taken in relation to a work vehicle, or a travel direction of the work vehicle, to which the components may be attached. In other examples, the components referenced by those terms may be reversed in accordance with the present disclosure.

Overview

An engine compartment typically contains the main components of a vehicle powerplant, including the engine block, electrical power components, and cooling system. One or more wiring harnesses include the sets of wires, connectors and contacts that are distributed throughout the vehicle to bring power from the engine block and electric power source to the various work components of the vehicle. The wiring harness and other power plant components need to resist vehicle, environmental and weather elements (e.g., heat and abrasion) for proper performance during normal operation of the vehicle, especially within the high temperature environment of the engine compartment. It is desirable to clean (e.g., pressure wash) and then treat (e.g., paint and coat) these components (e.g. to protect them from rust and corrosion and enhance their aesthetics). The electrical connectors provided as part of the wiring harness have various openings and passageways that may become blocked or subject internal components to pressures or build-up of material, and thus may compromise the performance and reliability of the electrical connector itself and the electrical system overall. To address this, a plug and cover arrangement may be used to cover and protect the connectors. A conventional arrangement of this kind will now be described in connection with FIGS. 1-4.

Such an electrical connector 10 of a wiring harness 12 for an engine block 14 includes a cap assembly 16 and a plug assembly 18 that are releasably mated together in a known. The electrical connector 10 is suitable for use in off-road, heavy duty industrial, recreational and agricultural applications. An example of such an electrical connector 10 is an AMPSEAL 16 connector commercially available from TE Connectivity.

The cap assembly 16 includes an electrically insulative housing 20 having a cavity (not shown) extending from a front face 22 thereof to an internal wall (not shown) having a plurality of wire receiving passageways 24 which extend from a rear end of the cavity to an exit face 26 of the insulative housing 20. The insulative housing 20 includes a plurality of internal latch arms (not shown), each of which are configured to extend into a respective wire receiving passageway 24 when in an unbiased position. A flexible sealing member (not shown) having a plurality of openings is positioned within the housing 20 adjacent to the plurality of wire receiving passageways 24 at the exit face 26. Respective ones of the openings in the sealing member align longitudinally with respective ones of the wire receiving passageways 24. Conductive wires 28 of the wiring harness 12 extend through the exit face 26, the openings in the sealing member, and through the wire receiving passageways 24 and into the cavity. Each latch arm 38 has a catch 40 which engages with the respective wire 28 to prevent the easy removal of the wires 28 from the cap assembly 16 in a known manner.

The plug assembly 18 includes an electrically insulative housing 30 having a plurality of contact receiving passageways 32 extending between an exit face 34 and a front face 36 of the insulative housing 30. The insulative housing 30 includes a plurality of latch arms 38, each of which are configured to extend into a respective contact receiving passageway 32 when in an unbiased position. Each latch arm 38 has a catch 40 at an end thereof. A flexible sealing member 42 having a plurality of openings 44 is positioned within the housing 30 and forms part of the contact receiving passageways 32. To form an electrical connection with the cap assembly 16, conductive contacts (not shown) extend through the exit face 34, and through the contact receiving passageways 32. The latch arms 38 engage with the contacts to prevent the easy removal of the contacts from the plug assembly 18. When the plug assembly 18 is mated with the cap assembly 16 in a known manner, the contacts in the plug assembly 18 couple with the wires in the cap assembly 16 to form electrical connections.

To prepare the electrical connector 10 and wiring harness 12 for the spray operation, the plug assembly 18 having the contacts therein is removed from the cap assembly 16 in a known manner to disconnect the contacts from the wires, and a new plug assembly 18 which does not have the contacts mounted therein is mated with the cap assembly 16. A seal member (not shown) is positioned between the cap assembly 16 and the plug assembly 18 to seal the connection therebetween. Since the contact receiving passageways 32 are open at the exit face 34, a plurality of individual plastic plugs 46 are inserted into all of the contact receiving passageways 32, except for two of the contact receiving passageways 32. Each individual plastic plug 46 has an enlarged head 48 at an end of a reduced diameter neck 50. The necks 50 are sized to fill the contact receiving passageways 32, but the enlarged heads 48 are prevented from entering therein. Socket contacts 52 having wires 54 crimped thereto are inserted into the remaining two contact receiving passageways 32. Each socket contact 52 has a notch 56 therein which engages with the catch 40 on the flexible latch arm 38 in the plug assembly 18 to prevent the easy withdrawal of the socket contacts 52 from the plug assembly 18. The wires 54 extend outwardly from the plug assembly 18 and have heat shrink sleeves 58 on the ends thereof.

To further protect the contact receiving passageways 32 from contaminant intrusion during spraying, a connector cover 60 (sometimes referred to as a dust cover) formed of a flexible material is seated over the plug assembly 18 with the wires 54 extending from an end thereof. The connector cover 60 is formed of a flexible material, such as thermoplastic or durable plastisol. The connector cover 60 has a front wall portion 62, a rear wall portion 64, and an intermediate wall portion 66 between the front and rear wall portions 62, 64. Each wall portion 62, 64 extends in a longitudinal direction, and the end wall portion 66 extends in a direction transverse to the longitudinal direction. An interior cavity 68 having open opposite openings 70, 72 at opposite ends thereof is defined through the front wall portion 62, the intermediate wall portion 66 and the rear wall portion 64. The cavity 68 includes a front section defined by the front side wall portion 62, and a rear section defined by the intermediate wall portion 66 and the rear wall portion 64. The front section of the cavity 68 generally mirrors the shape of the outer profile of the housing 30 of the plug assembly 18. The rear section of the cavity 68 has a portion which generally mirrors the shape of the plug body 102 and the wires 54.

The connector cover 60 is placed over the plug assembly 18 with the cavity plugs 46 and the socket contacts 52 inserted therein, such that the housing 30 of the plug assembly 18 is substantially enveloped by the wall portions 62, 66, and the exit face 34 of the housing 30 is proximate to the intermediate wall portion 66. Since the front section of the cavity 68 mirrors the shape of the outer profile of the housing 30, the front wall portion 62 engages with the outer surfaces of the housing 30 to form an environment seal therewith. The wires 54 extend through the intermediate wall portion 66 and into the rear section 64, which forms a mounting coupling, of the cavity 68 and outwardly from the opening 70. Once the connector cover 60 is attached to the plug assembly 18 with the cavity plugs 46 and the socket contacts 52 inserted therein, a closure 74 is engaged over the rear wall portion 64 of the connector cover 60 to clamp the rear wall portion 64 onto the cover support 104. The closure 74 may be a clamp, tie, bonding, or various fasteners, which is engaged over the connector cover 60 to clamp the connector cover 60 onto the cover support 104. In certain examples, the closure 74 is a conventional cable tie fastener. This prevents the connector cover 60 from disengaging with the cavity plug 100.

Once the individual cavity plugs 46 and the connector cover 60 are attached to the plug assembly 18, which is in turn connected to the wiring harness 12 via the cap assembly 16, the electrical connector 10, wiring harness 12, and engine block 14 are ready to be cleaned by a high pressure spray and then painted. The plastic plugs 46, the socket connectors 52, and the connector cover 60 prevent the intrusion of the high pressure water spray and paint into the contact receiving passageways 32. After painting, the plug assembly 18 is released from the cap assembly 16 and the pre-wired plug assembly 18 is reattached to the cap assembly 16.

Because each cavity plug 46 and each contact socket 52 must be individually attached to the plug assembly 18, the process is complicated and labor-intensive. In addition, one or more of the plastic plugs 46 may inadvertently be omitted leaving one or more contact receiving passageways 32 open and thereby leaving the electrical contacts within the cap assembly 16 susceptible to damage or coating, which may compromise the performance of the electrical connector 10 and the electrical system of the vehicle.

This disclosure provides an improved cavity plug and cover assembly with a combination cavity plug with a pin array that simultaneously blocks all of the passageways of the plug assembly and a cover support that mounts a connector cover (sometimes referred to as a dust cover) that covers the electrical connector at least in part. The pin array and the cover seal and protect the electrical connector from pressures and substances involved in the washing and painting operations. The combination cavity plug allows the pin array to be simply plugged into all of the passageways of the plug assembly in a single motion, thereby blocking all passageways at the same time. In addition, the cavity plug may be removed from the plug assembly easily by pulling the pin array out from the plug assembly in a single motion. Attachment and detachment of cavity plug to and from the plug assembly may be done quickly and easily thereby reducing assembly time. Moreover, the pin array eliminates the possibility of leaving contact receiving passageways of the plug assembly open, thereby eliminating the damage to or inoperability of the electrical connector that may otherwise be associated with leaving a contact receiving opening unblocked during spray treatment.

The cavity plug and cover assembly, especially the cavity plug, of this disclosure may take various forms. For example, the cavity plug may be an assembly of parts or may be a unitary, monolithic piece. In either case, the cavity plug includes a plug body from which a pin array extends in one direction and a cover support extends in the opposite direction. The pin array may include one or more blocking pins and one or more latching pins. The blocking pins may have a cylindrical configuration sized of a diameter and length to fit into associated contact receiving passageways of the connector. In various embodiments, there are a plurality of blocking pins of a designated number to match the number of contacts of the plug assembly (e.g., 2, 3, 4, 6, 8, 12 pin connectors) while accommodating the one or more latching pins. Each latching pin has a cylindrical body joined by a narrowed cylindrical neck to a cylindrical head, all sized to fit into an associated one of the contact receiving passageways of the plug assembly. Each latching pin is configured to inhibit separation of the cavity plug from the plug assembly. For example, the latching pin may be longer than the blocking pin(s) such that head projects further into the plug assembly than the blocking pins in order to engage one or more catches in the plug assembly that permanently or releasably engage the latching pin to permanently or releasably couple the cavity plug to the plug assembly. Various other configurations are within the scope of this disclosure.

The cover support may be a single elongated rod or pin projection that is integrally formed with or permanently or releasably connected to the plug body of the cavity plug. The cover support may extend into or through an opening in the connector cover, such may be a rigid or compliant sheath or housing sized and configured to receive and fit over the connector. The connector cover may be attached to the cover support by any suitable technique (e.g., clamps, ties, bonding, or various fasteners). In certain examples, conventional cable tie fasteners may be used.

Example Embodiment(s) of the Cavity Plug and Cover Assembly

Referring to FIG. 5-9, in some embodiments, the disclosed cavity plug 100 is provided for use with the electrical connector 10 coupled to the wiring harness 12 of the engine block 14, and for use in supporting the connector cover 60, see FIG. 1. The electrical connector 10 includes the cap assembly 16 and the plug assembly 18 described hereinabove, which are releasably mated together in a known manner. The specifics of the cap assembly 16 and the plug assembly 18 are not repeated herein. As described herein, the connector cover 60 (sometimes referred to as a dust cover) is formed of a flexible material, such as thermoplastic or durable plastisol, and has a front wall portion 62, a rear wall portion 64, and an intermediate wall portion 66 between the front and rear wall portions 62, 64. Each wall portion 62, 64 extends in a longitudinal direction, and the end wall portion 66 extends in a direction transverse to the longitudinal direction. An interior cavity 68 having open opposite openings 70, 72 at opposite ends thereof is defined through the front wall portion 62, the intermediate wall portion 66 and the rear wall portion 64. The cavity 68 includes a front section defined by the front side wall portion 62, and a rear section defined by the intermediate wall portion 66 and the rear wall portion 64. The front section of the cavity 68 generally mirrors the shape of the outer profile of the housing 30 of the plug assembly 18.

Figure 7:
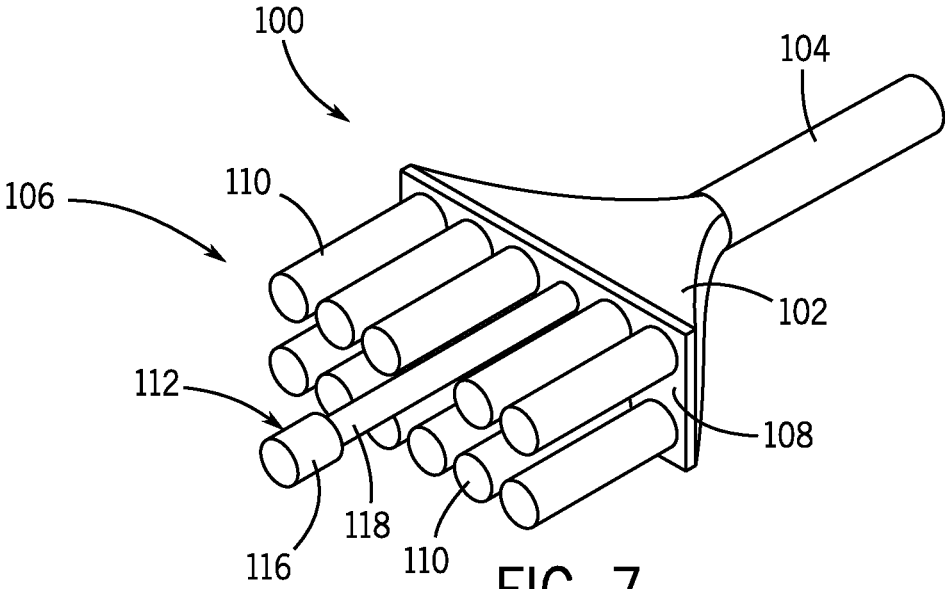
FIG. 7 is an isometric view of the cavity plug of FIG. 5.
Figure 8:
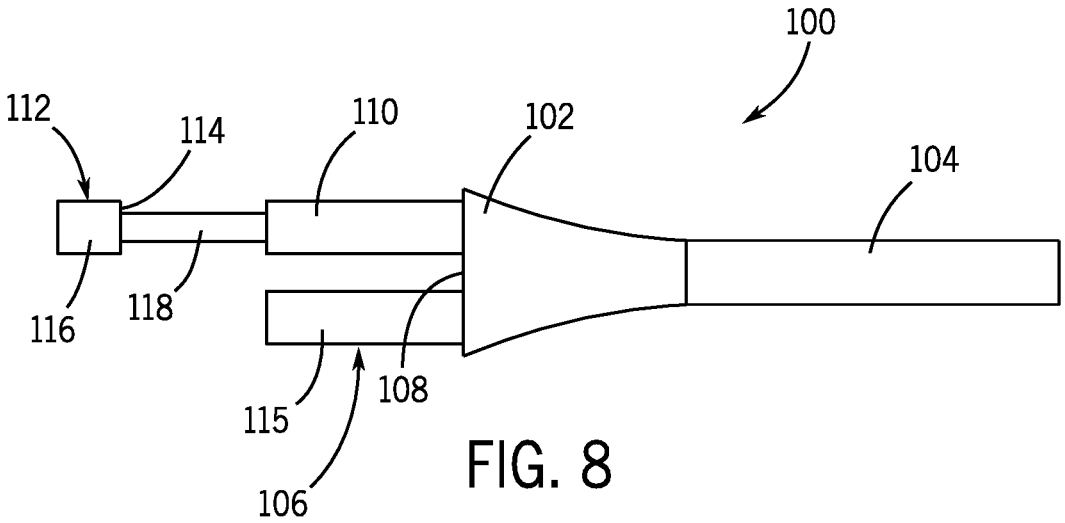
FIG. 8 is a side elevation view of the cavity plug of FIG. 5.
Figure 9:
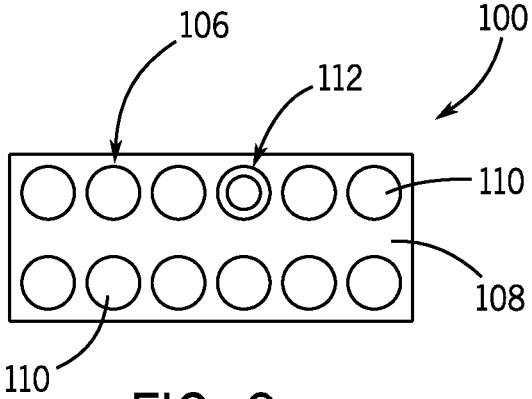
FIG. 9 is a front end view of the cavity plug of FIG. 5.

The cavity plug 100 is used to simultaneously block all of the contact receiving passageways 32 in the plug assembly 18 when inserted therein. As best shown in FIGS. 7-9, the cavity plug 100 includes a plug body 102, a cover support 104 extending from the plug body 102 in a first direction, and a pin array 106 extending from the plug body 102 in a second direction which is opposite to the first direction. The plug body 102 has a peripheral face surface 108 which extends within a plane bisecting the first and second directions. The plug body 102, the cover support 104, and the pin array 106 may be an assembly of parts or a unitary, monolithic piece integrally formed of the same material. The cavity plug 100 is formed of an insulative material, may be formed of a rigid material, and may be formed of rigid plastic.

The cover support 104 may be an elongated rod or pin projection and may extend from a center of the plug body 102. The cover support 104 extends away from the peripheral face surface 108.

As shown, the pin array 106 includes a plurality of blocking pins 110 and a latching pin 112. Each blocking pin 110 is formed from a body, which may be cylindrical, and having a length; the lengths may be identical or may be different. Each blocking pin 110 is sized to substantially fill the contact receiving passageway 32 into which it is inserted and to engage with the wall forming the associated opening 44 in the sealing member 42 to form a seal therewith. A plurality of blocking pins 110 are shown in the drawings, however, one or more than one blocking pins 110 may be provided depending upon the number of contact receiving passageways 32 within the plug assembly 18. The latching pin 112 is formed from a body which is some embodiments has a length which is greater than the lengths of the blocking pins 110. Only one latching pin 112 is shown in the drawings, however, more than one latching pin 112 may be provided. The latching pin 112 is sized to substantially fill the contact receiving passageway 32 into which it is inserted and to engage with the wall forming the associated opening 44 in the sealing member 42. The latching pin 112 has a surface which is configured to engage with the latch arm 38 to lock the latching pin 112 and the latch arm 38 together. In some embodiments, the surface is formed by a shoulder 114 formed by an enlarged head 116 at an end of a reduced diameter neck 118 that extends from the peripheral face surface 108 of the plug body 102. The enlarged head 116 and neck 118 may be cylindrical. The blocking pins 110 and the latching pin 112 are arranged to correspond to the arrangement of the openings 44 in the sealing member 42 and the contact receiving passageways 32 in the housing 30. In an embodiment, the blocking pins 110 and the latching pin 112 are arranged in a plurality of rows and columns. A longitudinal centerline of each blocking pin 110, a longitudinal centerline of the latching pin 112, and a longitudinal centerline of the cover support 104 are parallel to each other.

When the cavity plug 100 is inserted into the plug assembly 18 through the exit face 34, the latching pin 112 passes through one of the openings 44 in the sealing member 42, and thereafter enters into one of the contact receiving passageways 32, and the blocking pins 110 pass through the remaining openings 44 in the sealing member 42 enter into and fill a portion of the remaining contact receiving passageways 32. The enlarged head 116 of the latching pin 112 engages with the catch 40 of the latch arm 38 in the particular contact receiving passageway 32, and biases the latch arm 38 out of the contact receiving passageway 32. After the enlarged head 116 passes by the end of the latch arm 38, the latch arm 38 resumes its unbiased position and the catch 40 engages with the shoulder 114 of the latching pin 112. This engagement prevents the easy withdrawal of the cavity plug 100 from the plug assembly 18. The blocking pins 110 may be long enough to engage with the latch arms 38 in the respective contact receiving passageways 32, or may be shorter so as to not engage with the latch arms 38 in the respective contact receiving passageways 32. The neck 118 of the latching pin 112 is frictionally engaged with the wall forming the opening 44 in the sealing member 42. The blocking pins 110 are frictionally engaged with the walls forming the contact receiving passageway 32 and forming the openings 44 in the sealing member 42. The frictional engagements of the neck 118 of the latching pin 112 and the blocking pins 110 with the sealing member 42 form a seal between the cavity plug 100 and the plug assembly 18. The peripheral face surface 108 of the plug body 102 abuts against the exit face 34 of the plug assembly 18 and may sit flush against the exit face 34. The cover support 104 extends away from the peripheral face surface 108.

The connector cover 60 is placed over the plug assembly 18 with the cavity plug 100 inserted therein, such that the housing 30 of the plug assembly 18 is substantially enveloped by the wall portions 62, 66, and the exit face 34 of the housing 30 is proximate to the intermediate wall portion 66. The plug body 102 of the cavity plug 100 is also enveloped by the wall portions 62, 66. Since the front section of the cavity 68 mirrors the shape of the outer profile of the housing 30, the front wall portion 62 engages with the outer surfaces of the housing 30 to form an environment seal therewith. The plug body 102 and the cover support 104 extend through the intermediate wall portion 66 and into the rear section 64 of the cavity 68. The rear section 64 forms a mounting coupling. The cover support 104 may have a length which is sufficiently long so that it extends longitudinally outward of the opening 70 of the rear wall portion 64. Once the connector cover 60 is attached to the plug assembly 18 with the cavity plug 100 inserted therein, the closure 74 (the specifics of which are not repeated) is engaged over the rear wall portion 64 of the connector cover 60 to clamp the rear wall portion 64 onto the cover support 104.

Once the cavity plug 100 is engaged with the plug assembly 18 and the connector cover 60 is engaged with the plug assembly 18 and the cavity plug 100, a pressure washing operation and a painting operation can be undertaken. The cavity plug 100 and the connector cover 60 prevent the entry of contaminants into the contact receiving passageways 32 through the exit face 34. Since the cavity plug 100 simultaneously blocks all of the contact receiving passageways 32 in the plug assembly 18, the labor cost for assembling the components is reduced. The cavity plug 100 provides for a quick attachment to and detachment from the plug assembly 18. In addition, the cavity plug prevents the inadvertent omission of a plug within a contact receiving passageways 32.

The foregoing describes an example cavity plug in detail. Various other configurations are possible within the scope of this disclosure.

ENUMERATED EXAMPLES

Also, the following examples are provided, which are numbered for easier reference.

1. A cavity plug for a plug assembly of an electrical connector, the plug assembly having a connector housing defining contact receiving passageways, the cavity plug comprising: a plug body; a cover support extending from the plug body in a first direction and configured to support a connector cover that receives the connector housing; a pin array extending from the plug body in a second direction opposite the first direction, the pin array including: one or more blocking pins having bodies extending in the second direction and sized for insertion into one or more associated contact receiving passageways of the plug assembly; and one or more latching pins extending in the second direction and configured to cooperate with the plug assembly to inhibit separation of the cavity plug from the plug assembly.

2. The cavity plug of example 1, wherein the plug body and pin array form an integral, unitary part.

3. The cavity plug of example 1, wherein the plug body, the pin array and the cover support form an integral unitary part.

4. The cavity plug of example 1, wherein the pin array includes a plurality of the blocking pins having cylindrical bodies arranged in multiple rows or columns.

5. The cavity plug of example 1, wherein the pin array includes a single latching pin.

6. The cavity plug of example 5, wherein the latching pin includes a cylindrical body joined by a narrowed neck to a cylindrical head; and wherein the head of the latching pin extends in the second direction farther than the one or more blocking pins to engage a catch within the connector housing.

7. The cavity plug of example 1, wherein the cover support is a single rod extending in the first direction.

8. The cavity plug of example 1, wherein the plug body defines a peripheral face surface extending within a plane bisecting the first and second directions and configured to engage a face surface of the plug assembly.

9. A cavity plug for a plug assembly of an electrical connector, the plug assembly having a connector housing defining contact receiving passageways, the cavity plug comprising: a plug body; a cover support extending from the plug body in a first direction and configured to support a connector cover that receives the connector housing; a pin array extending from the plug body in a second direction opposite the first direction, the pin array including: a plurality of blocking pins having bodies extending in the second direction and sized for insertion into associated contact receiving passageways of the plug assembly; and at least one latching pin extending in the second direction and configured to cooperate with the plug assembly to inhibit separation of the cavity plug from the plug assembly.

10. A cavity plug for a plug assembly of an electrical connector, the plug assembly having a connector housing defining contact receiving passageways, the cavity plug comprising: a plug body; a cover support extending from the plug body in a first direction and configured to support a connector cover that receives the connector housing; a pin array extending from the plug body in a second direction opposite the first direction, the pin array including: a plurality of blocking pins having bodies extending in the second direction and sized for insertion into associated contact receiving passageways of the plug assembly; and at least one latching pin extending in the second direction and configured to cooperate with the plug assembly to inhibit separation of the cavity plug from the plug assembly.

11. The cavity plug of example 10, wherein the plug body, the pin array and the cover support form an integral unitary part.

12. The cavity plug of example 10, wherein the connector cover includes a mounting coupling; and wherein the cover support include a rod extending in the first direction and into the mounting coupling.

13. The cavity plug of example 12, further comprising a closure encircling the mounting coupling of the connector cover and the rod of the cover support to engage the connector cover with the rod.

14. The cavity plug of example 10, wherein the plug body defines a peripheral face surface extending within a plane bisecting the first and second directions and configured to engage a face surface of the plug assembly.

15. The cavity plug of example 14, wherein the at least one latching pin includes a cylindrical body joined by a narrowed neck to a cylindrical head; and wherein the head of the latching pin extends in the second direction farther than the blocking pins to engage a catch within the connector housing.

CONCLUSION

The examples discussed above result in a variety of benefits of the disclosed electrical connector cavity plug and cover assembly. For example, the cavity plug provides for a quick attachment and detachment from the plug assembly, thereby reducing labor for assembly. In addition, the cavity plug prevents the inadvertent omission of an individual plug within a connector cavity and the associated potential for damage to or loss of function of the electrical connector.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A cavity plug for a plug assembly of an electrical connector, the plug assembly having a connector housing defining contact receiving passageways, the cavity plug comprising:

a plug body;

a cover support extending from the plug body in a first direction and configured to support a connector cover that receives the connector housing;

a pin array extending from the plug body in a second direction opposite the first direction, the pin array including:

one or more blocking pins having bodies extending in the second direction and sized for insertion into one or more associated contact receiving passageways of the plug assembly; and one or more latching pins extending in the second direction and configured to cooperate with the plug assembly to inhibit separation of the cavity plug from the plug assembly.

2. The cavity plug of claim 1, wherein the plug body and pin array form an integral, unitary part.

3. The cavity plug of claim 1, wherein the plug body, the pin array and the cover support form an integral unitary part.

4. The cavity plug of claim 1, wherein the pin array includes a plurality of the blocking pins having cylindrical bodies arranged in multiple rows or columns.

5. The cavity plug of claim 1, wherein the pin array includes a single latching pin.

6. The cavity plug of claim 5, wherein the latching pin includes a cylindrical body joined by a narrowed neck to a cylindrical head; and wherein the head of the latching pin extends in the second direction farther than the one or more blocking pins to engage a catch within the connector housing.

7. The cavity plug of claim 1, wherein the cover support is a single rod extending in the first direction.

8. The cavity plug of claim 1, wherein the plug body defines a peripheral face surface extending within a plane bisecting the first and second directions and configured to engage a face surface of the plug assembly.

9. A cavity plug for a plug assembly of an electrical connector, the plug assembly having a connector housing defining contact receiving passageways, the cavity plug comprising:

a plug body;

a cover support extending from the plug body in a first direction and configured to support a connector cover that receives the connector housing;

a pin array extending from the plug body in a second direction opposite the first direction, the pin array including:

a plurality of blocking pins having bodies extending in the second direction and sized for insertion into associated contact receiving passageways of the plug assembly; and at least one latching pin extending in the second direction and configured to cooperate with the plug assembly to inhibit separation of the cavity plug from the plug assembly.

10. The cavity plug of claim 9, wherein the plug body, the pin array and the cover support form an integral unitary part.

11. The cavity plug of claim 9, wherein the at least one latching pin includes a cylindrical body joined by a narrowed neck to a cylindrical head; and wherein the head of the latching pin extends in the second direction farther than the blocking pins to engage a catch within the connector housing.

12. The cavity plug of claim 9, wherein the cover support is a single rod extending in the first direction.

13. The cavity plug of claim 9, wherein the plug body defines a peripheral face surface extending within a plane bisecting the first and second directions and configured to engage a face surface of the plug assembly.

14. A cavity plug and cover assembly for a plug assembly of an electrical connector, the plug assembly having a connector housing defining contact receiving passageways, the cavity plug comprising:

a connector cover defining an open end and an interior cavity sized to receive, at least in part, the connector housing, the connector cover including a mounting coupling; and the cavity plug having:

a plug body; a cover support extending from the plug body in a first direction and configured to engage the mounting coupling of the connector cover; a pin array extending from the plug body in a second direction opposite the first direction, the pin array including: a plurality of blocking pins having bodies extending in the second direction and sized for insertion into associated contact receiving passageways of the plug assembly; and at least one latching pin extending in the second direction and configured to cooperate with the plug assembly to inhibit separation of the cavity plug from the plug assembly.

15. The assembly of claim 14, wherein the plug body, the pin array and the cover support form an integral unitary part.

16. The assembly of claim 14, wherein the cover support include a rod extending in the first direction and into the mounting coupling.

17. The assembly of claim 16, further comprising a closure encircling the mounting coupling of the connector cover and the rod of the cover support to engage the connector cover with the rod.

18. The assembly of claim 14, wherein the plug body defines a peripheral face surface extending within a plane bisecting the first and second directions and configured to engage a face surface of the plug assembly.

19. The assembly of claim 14, wherein the at least one latching pin includes a cylindrical body joined by a narrowed neck to a cylindrical head; and wherein the head of the latching pin extends in the second direction farther than the blocking pins to engage a catch within the connector housing.

20. The assembly of claim 19, wherein the at least one latching pin releasably engages the catch.

* * * * *